US009849949B2

(12) United States Patent
Arias

(10) Patent No.: US 9,849,949 B2
(45) Date of Patent: Dec. 26, 2017

(54) COLLAPSIBLE FLOTATION DEVICE

(71) Applicant: Kelsyus, LLC, Virginia Beach, VA (US)

(72) Inventor: David A. Arias, Virginia Beach, VA (US)

(73) Assignee: Kelsyus, LLC, Virginia Beach, VA (US)

( * ) Notice: Subject to any disclaimer, the term of this patent is extended or adjusted under 35 U.S.C. 154(b) by 0 days.

(21) Appl. No.: 14/980,596

(22) Filed: Dec. 28, 2015

(65) Prior Publication Data

US 2016/0114872 A1 Apr. 28, 2016

Related U.S. Application Data

(63) Continuation of application No. 14/016,876, filed on Sep. 3, 2013, now Pat. No. 9,221,526, which is a continuation of application No. 13/328,779, filed on Dec. 16, 2011, now Pat. No. 8,523,623, which is a continuation of application No. 12/890,240, filed on Sep. 24, 2010, now Pat. No. 8,079,888, which is a continuation of application No. 12/400,214, filed on Mar. 9, 2009, now Pat. No. 7,811,145, which is a continuation of application No. 12/028,227, filed on (Continued)

(51) Int. Cl.

| | |
|---|---|
| ***B63C 9/08*** | (2006.01) |
| ***B63B 7/08*** | (2006.01) |
| ***B63B 35/607*** | (2006.01) |
| ***B63B 35/76*** | (2006.01) |
| ***B63C 9/04*** | (2006.01) |
| ***B63C 9/105*** | (2006.01) |
| ***B63B 35/73*** | (2006.01) |

(52) U.S. Cl.

CPC ..... *B63C 9/081* (2013.01); *B63B 7/08* (2013.01); *B63B 35/607* (2013.01); *B63B 35/73* (2013.01); *B63B 35/76* (2013.01); *B63C 9/04* (2013.01); *B63C 9/08* (2013.01); *B63C 9/082* (2013.01); *B63C 9/1055* (2013.01); *B63C 2009/042* (2013.01)

(58) Field of Classification Search

CPC ..... B63B 35/76

See application file for complete search history.

(56) References Cited

U.S. PATENT DOCUMENTS

| | | | |
|---|---|---|---|
| 722,801 | A | 3/1903 | Bourne, Jr. |
| 772,690 | A | 10/1904 | Baswitz |
| 856,279 | A | 6/1907 | Moore |
| 1,190,743 | A | 7/1916 | Fageol |
| 1,479,903 | A | 1/1924 | Erland |
| 1,960,474 | A | 5/1934 | Browne |
| 2,119,023 | A | 5/1938 | Pickard |
| 2,173,963 | A | 9/1939 | Eubank |
| 2,190,566 | A | 2/1940 | Julian |
| 2,207,025 | A | 7/1940 | Rison |
| 2,334,924 | A | 11/1943 | Hansen |
| 2,344,010 | A | 3/1944 | Walsh |
| 2,357,789 | A | 9/1944 | Levy |

(Continued)

FOREIGN PATENT DOCUMENTS

| | | |
|---|---|---|
| CN | 2274170 | 2/1998 |
| EP | 0974293 | 1/2000 |

(Continued)

OTHER PUBLICATIONS

*Swimways Corp.*, v. *Overbreak, LLC*, Order, Case No. 1:04cv627, dated Jan. 18, 2005.

(Continued)

*Primary Examiner* — Stephen P Avila

(57) ABSTRACT

A device comprises a spring and a sleeve. The spring is configured to form a closed loop. The spring is moveable between a coiled configuration when the spring is collapsed and an uncoiled configuration when the spring is expanded. The spring defines a circumference while in the uncoiled configuration. The spring is disposed within the sleeve.

20 Claims, 5 Drawing Sheets

Related U.S. Application Data

Feb. 8, 2008, now Pat. No. 7,500,893, which is a continuation of application No. 11/554,197, filed on Oct. 30, 2006, now Pat. No. 7,335,080, which is a continuation of application No. 11/143,703, filed on Jun. 3, 2005, now Pat. No. 7,134,930, which is a continuation of application No. 10/847,339, filed on May 18, 2004, now Pat. No. 7,147,528, which is a continuation of application No. 10/295,906, filed on Nov. 18, 2002, now Pat. No. 7,097,524, which is a continuation of application No. 09/772,739, filed on Jan. 30, 2001, now Pat. No. 6,485,344.

(60) Provisional application No. 60/238,988, filed on Oct. 10, 2000.

(56) References Cited

U.S. PATENT DOCUMENTS

| | | | |
|---|---|---|---|
| 2,360,715 | A | 10/1944 | Perry |
| 2,420,344 | A | 5/1947 | Alexander |
| 2,442,105 | A | 5/1948 | Vacheron |
| 2,637,861 | A | 5/1953 | Kethledge |
| 2,731,997 | A | 1/1956 | Muth et al. |
| 2,803,291 | A | 8/1957 | Meyer |
| 2,803,839 | A | 8/1957 | Mosley |
| 2,870,464 | A | 1/1959 | Lalick |
| D187,313 | S | 2/1960 | Denyer |
| 2,953,184 | A | 9/1960 | Erstad |
| 3,052,895 | A | 9/1962 | Lo Vico |
| 3,336,610 | A | 8/1967 | Geddings |
| 3,339,218 | A | 9/1967 | Stamberger |
| 3,602,930 | A | 9/1971 | Channon |
| 3,653,084 | A | 4/1972 | Hartman |
| D225,183 | S | 11/1972 | Waters |
| 3,775,782 | A | 12/1973 | Rice et al. |
| 3,842,454 | A | 10/1974 | Young |
| 3,860,976 | A | 1/1975 | Suyama |
| 3,862,876 | A | 1/1975 | Graves |
| 3,871,042 | A | 3/1975 | Farmer |
| D236,287 | S | 8/1975 | McNair |
| 3,960,161 | A | 6/1976 | Norman |
| 3,990,463 | A | 11/1976 | Norman |
| 4,097,944 | A | 7/1978 | Yulish |
| 4,200,942 | A | 5/1980 | Case |
| 4,231,125 | A | 11/1980 | Tittl |
| D261,464 | S | 10/1981 | Smith |
| 4,296,788 | A | 10/1981 | Slater |
| 4,435,236 | A | 3/1984 | Inae et al. |
| 4,478,587 | A | 10/1984 | Mackal |
| 4,512,049 | A | 4/1985 | Henry |
| 4,561,480 | A | 12/1985 | Underwood et al. |
| 4,576,375 | A | 3/1986 | Roberts |
| 4,693,691 | A | 9/1987 | DeYoe |
| D293,012 | S | 12/1987 | Storey et al. |
| 4,709,430 | A | 12/1987 | Nicoll |
| 4,766,918 | A | 8/1988 | Odekirk |
| 4,815,784 | A | 3/1989 | Zheng |
| 4,825,892 | A | 5/1989 | Norman |
| 4,858,634 | A | 8/1989 | McLeese |
| 4,861,300 | A | 8/1989 | Casagrande et al. |
| 4,942,838 | A | 7/1990 | Boyer et al. |
| 4,944,707 | A | 7/1990 | Silverglate |
| 4,946,067 | A | 8/1990 | Kelsall |
| 4,951,333 | A | 8/1990 | Kaiser et al. |
| 4,973,278 | A | 11/1990 | Williams |
| 4,976,642 | A | 12/1990 | Wilkie |
| 4,986,781 | A | 1/1991 | Smith |
| 5,006,087 | A | 4/1991 | Peterson |
| 5,024,262 | A | 6/1991 | Huang |
| 5,038,812 | A | 8/1991 | Norman |
| 5,045,011 | A | 9/1991 | Lovik |
| 5,046,978 | A | 9/1991 | Howerton |
| 5,056,172 | A | 10/1991 | Kaiser et al. |
| 5,059,463 | A | 10/1991 | Peters |
| 5,070,807 | A | 12/1991 | Lewis |
| 5,088,723 | A | 2/1992 | Simmons |
| D325,489 | S | 4/1992 | Pratt |
| 5,116,273 | A | 5/1992 | Chan |
| 5,123,869 | A | 6/1992 | Schipmann |
| D328,324 | S | 7/1992 | Wang |
| 5,163,192 | A | 11/1992 | Watson |
| 5,163,461 | A | 11/1992 | Ivanovich et al. |
| 5,167,554 | A | 12/1992 | Tager |
| 5,186,667 | A | 2/1993 | Wang |
| 5,206,964 | A | 5/1993 | Wilson, Sr. |
| 5,213,147 | A | 5/1993 | Zheng |
| 5,261,131 | A | 11/1993 | Kilby |
| 5,299,331 | A | 4/1994 | Badillo |
| D349,593 | S | 8/1994 | Hensley |
| D349,625 | S | 8/1994 | da Palma |
| 5,334,067 | A | 8/1994 | Henry et al. |
| D350,586 | S | 9/1994 | Francis |
| 5,345,627 | A | 9/1994 | Cammarata |
| 5,358,440 | A | 10/1994 | Zheng |
| 5,385,518 | A | 1/1995 | Turner |
| 5,396,917 | A | 3/1995 | Hazinski et al. |
| 5,430,980 | A | 7/1995 | Ferrier |
| 5,433,433 | A | 7/1995 | Armell |
| 5,435,025 | A | 7/1995 | Gerard et al. |
| 5,454,643 | A | 10/1995 | Sullivan |
| 5,467,794 | A | 11/1995 | Zheng |
| 5,476,404 | A | 12/1995 | Price |
| D366,177 | S | 1/1996 | Dean |
| 5,520,561 | A | 5/1996 | Langenohl |
| D371,252 | S | 7/1996 | Chaput |
| 5,533,653 | A | 7/1996 | Kaufman |
| D373,483 | S | 9/1996 | Peterson |
| 5,560,385 | A | 10/1996 | Zheng |
| 5,571,036 | A | 11/1996 | Hannigan |
| 5,579,799 | A | 12/1996 | Zheng |
| 5,592,961 | A | 1/1997 | Chin |
| D378,772 | S | 4/1997 | Hall |
| 5,618,110 | A | 4/1997 | Sullivan |
| 5,618,246 | A | 4/1997 | Zheng |
| 5,619,759 | A | 4/1997 | Hansen et al. |
| RE35,571 | E | 7/1997 | McLeese |
| 5,644,807 | A | 7/1997 | Battistella |
| 5,688,052 | A | 11/1997 | Compton |
| 5,693,398 | A | 12/1997 | Granger |
| D389,362 | S | 1/1998 | Boulatian |
| 5,718,612 | A | 2/1998 | Elsholz |
| 5,729,846 | A | 3/1998 | Sullivan |
| 5,730,529 | A | 3/1998 | Fritz et al. |
| D398,694 | S | 9/1998 | Boddy |
| 5,810,695 | A | 9/1998 | Sass |
| 5,816,954 | A | 10/1998 | Zheng |
| D400,749 | S | 11/1998 | Bechtold, Jr. |
| D404,104 | S | 1/1999 | Scheurer et al. |
| D406,870 | S | 3/1999 | Bauman |
| 5,885,123 | A | 3/1999 | Clifford |
| 5,976,023 | A | 11/1999 | Cho |
| 6,012,778 | A | 1/2000 | Peterson |
| 6,030,300 | A | 2/2000 | Zheng |
| D424,313 | S | 5/2000 | Linder |
| D425,357 | S | 5/2000 | Waring |
| D426,415 | S | 6/2000 | Le Gette et al. |
| D426,714 | S | 6/2000 | Linder |
| 6,073,283 | A | 6/2000 | Zheng |
| D428,090 | S | 7/2000 | Peterson |
| D428,099 | S | 7/2000 | Peterson |
| 6,086,150 | A | 7/2000 | Scheurer et al. |
| 6,113,453 | A | 9/2000 | Stuffelbeam |
| D435,240 | S | 12/2000 | Peterson |
| 6,161,902 | A | 12/2000 | Lieberman |
| 6,168,489 | B1 | 1/2001 | Huston |
| 6,170,100 | B1 | 1/2001 | Le Gette et al. |
| 6,192,635 | B1 | 2/2001 | Zheng |
| 6,223,673 | B1 | 5/2001 | Mears et al. |
| 6,224,444 | B1 | 5/2001 | Klimenko |
| 6,225,940 | B1 | 5/2001 | Ohlsen |
| 6,257,943 | B1 | 7/2001 | Peterson |
| 6,276,979 | B1 | 8/2001 | Saltel et al. |
| D447,661 | S | 9/2001 | Le Gette et al. |

(56) References Cited

U.S. PATENT DOCUMENTS

| | | | |
|---|---|---|---|
| D449,193 | S | 10/2001 | Le Gette et al. |
| 6,312,054 | B1 | 11/2001 | Scheurer et al. |
| 6,343,391 | B1 | 2/2002 | Le Gette et al. |
| D459,934 | S | 7/2002 | Le Gette et al. |
| D463,700 | S | 10/2002 | Le Gette et al. |
| D466,176 | S | 11/2002 | Peterson |
| 6,478,038 | B1 | 11/2002 | Le Gette et al. |
| 6,485,344 | B2 | 11/2002 | Arias |
| 6,491,558 | B1 | 12/2002 | Myers |
| D469,494 | S | 1/2003 | Arias |
| 6,527,343 | B2 | 3/2003 | Scheurer et al. |
| D480,777 | S | 10/2003 | Peterson |
| D481,435 | S | 10/2003 | Zheng |
| 6,634,040 | B2 | 10/2003 | Le Gette et al. |
| 6,645,026 | B2 | 11/2003 | Kuan |
| D483,088 | S | 12/2003 | Zheng |
| D492,380 | S | 6/2004 | Zheng |
| 6,908,353 | B2 | 6/2005 | Zheng |
| 6,915,537 | B2 | 7/2005 | Le Gette et al. |
| 6,971,936 | B2 | 12/2005 | Le Gette et al. |
| 7,097,524 | B2 | 8/2006 | Arias |
| 7,127,754 | B2 | 10/2006 | Le Gette et al. |
| 7,134,930 | B2 | 11/2006 | Arias |
| 7,137,856 | B2 | 11/2006 | Zheng |
| 7,147,528 | B2 | 12/2006 | Arias |
| 7,207,857 | B2 | 4/2007 | Zheng |
| 7,335,080 | B2 | 2/2008 | Arias |
| 7,370,379 | B2 | 5/2008 | Zheng |
| 7,490,378 | B2 | 2/2009 | Le Gette et al. |
| D596,438 | S | 7/2009 | Le Gette et al. |
| D610,216 | S | 2/2010 | Le Gette et al. |
| 7,665,164 | B2 | 2/2010 | Le Gette et al. |
| 7,727,038 | B2 | 6/2010 | Le Gette et al. |
| D632,914 | S | 2/2011 | Le Gette et al. |
| D640,492 | S | 6/2011 | Le Gette et al. |
| D642,232 | S | 7/2011 | Le Gette et al. |
| 8,066,540 | B2 | 11/2011 | Le Gette et al. |
| 8,079,888 | B2 | 12/2011 | Arias |
| D654,749 | S | 2/2012 | Le Gette et al. |
| 8,657,640 | B2 | 2/2014 | Le Gette et al. |
| D702,058 | S | 4/2014 | Le Gette et al. |
| 8,959,679 | B1 | 2/2015 | Everds et al. |
| D742,139 | S | 11/2015 | Le Gette |
| 9,221,526 | B2 | 12/2015 | Arias |
| 9,630,687 | B2 | 4/2017 | Le Gette et al. |
| 2002/0049017 | A1 | 4/2002 | Ross |
| 2003/0068940 | A1 | 4/2003 | Arias |
| 2003/0134549 | A1 | 7/2003 | Lekhtman |

FOREIGN PATENT DOCUMENTS

| | | | |
|---|---|---|---|
| EP | 1 008 706 | A2 | 6/2000 |
| FR | 2697421 | | 11/1992 |
| FR | 2697421 | | 4/1996 |
| GB | 258077 | | 9/1926 |
| GB | 2108435 | B | 4/1985 |
| JP | 48024199 | U | 7/1971 |
| JP | 48-024199 | U | 3/1973 |
| JP | 52-002895 | U | 1/1977 |
| JP | 1-133961 | U | 9/1989 |
| JP | 4-065567 | U | 6/1992 |

OTHER PUBLICATIONS

*Swimways Corp.,* v. *Overbreak, LLC,* Memorandum Opinion, Case No. 1:04cv627, dated Jan. 21, 2005.

Merriam-Websters Collegiate Dictionary ($10^{th}$ ed. 1998) pp. 190, 337, 598.

Office Action in Australian Patent Application No. 2002213464, dated May 26, 2005; 2 pages.

Office Action in Canadian Patent Application No. 2,425,348, dated Aug. 7, 2006; 2 pages.

Office Action in Chinese Patent Application No. 01819143.6, dated Feb. 17, 2006; 9 pages.

Office Action in Chinese Patent Application No. 01819143.6, dated Aug. 18, 2006; 5 pages.

Office Action in Chinese Patent Application No. 01819143.6, dated Feb. 27, 2009; 5 pages.

Office Action in Chinese Patent Application No. 01819143.6, dated Jul. 3, 2009; 6 pages.

Office Action in European Patent Application No. 01 981 847.5, dated May 17, 2006; 3 pages.

Office Action in Japanese Patent Application No. 2002-534140, dated Jan. 15, 2007; 2 pages.

Office Action in Japanese Patent Application No. 2002-534140, dated Jan. 15, 2008; 2 pages.

Office Action in Mexican Patent Application No. PA/a/2003/002949 PCT, dated Mar. 7, 2006; 3 pages.

Office Action in Australian Patent Application No. 2006202846, dated Apr. 7, 2009; 2 pages.

Office Action in Japanese Patent Application No. 2008-127246, dated Jan. 17, 2011, 2 pages.

Office Action for Chinese Patent Application No. 201010003813.8; dated Aug. 29, 2011; 13 pages.

Office Action for Chinese Patent Application No. 201010003813.8; dated Feb. 29, 2012; 8 pages.

Office Action for Australian Patent Application No. 2011202582; dated Jul. 29, 2011; 3 pages.

Office Action for Chinese Patent Application No. 201010003813.8, dated Sep. 5, 2012, 9 pages.

Defendant's Prior Art Statement, filed on Sep. 30, 2013 in *Swimways Corporation* v. *Aqua-Leisure Industries, Inc.* 3:12-cv-00205, 66 pages.

Markman Order, issued on Oct. 22, 2013, in *Swimways Corporation* v. *Aqua-Leisure Industries, Inc.* 3:12-cv-00205, 5 pages.

Aqua-Leisure 1993 Catalog, pp. 7, 12-13.

Bestway 2000 Catalog, pp. 8, 15, 28, and 73-74.

Bestway 2002 Catalog, 2 pages.

Bestway 2003 Catalog, pp. 36, 51-52, 54.

Intex 1994 Catalog, pp. 17, 30.

Intex 1999 Catalog, p. 41.

Intex 2001 Catalog, p. 34.

Swimline 1999 Catalog, pp. Al, 19.

Swimline 2002 Catalog, p. 31.

"How to Fold a Bicycle Tire," http://www.rideyourbike.com/tirefold.html, pp. 1-2, Mar. 9, 2001.

Swimclass Baby Boat packaging 2003.

Aqua-Leisure Adjustable Sunshade Wave Rider packaging 2001.

Aqua-Leisure Baby Boat packaging 1992.

Aqua-Leisure Squirtin' Tootin' Tugboat packaging 2001.

Don Hubbard, The Complete Book of Inflatable Boats (1980).

Hawley's Condensed Chemical Dictionary, Definition of "Resin, Synthetic" p. 1004 (1987).

Life Buoy as a Water Hammock, 16 Popular Mechanics, No. 3, 309, 313 (1911).

Swimways 1995 Catalog, Swimways Corp., 1995, pp. 5 and 18-19.

Swimways 1996 Catalog, Swimways Corp., 1996, pp. 4 and 20-23.

Swimways 1997 Catalog, Swimways Corp., 1997, pp. 6 and 18-20.

Swimways 1998 Catalog, Swimways Corp., 1998, pp. 13 and 15-17.

Swimways 1999 Catalog, Swimways Corp., 1999, pp. 10 and 21-22.

Swimways 2000 Catalog, Swimways Corp., 2000, pp. 2-5 and 17.

Swimways Lounges Summer 2001 Catalog, Swimways Corp., 2001, pp. 2-8.

Defendant Aqua-Leisure Industries, Inc.'s Amended Counterclaims, filed on Sep. 20, 2016 in *Swimways Corporation et al.* v. *Aqua-Leisure Industries, Inc.* 2:16-cv-00260, 19 pages.

Defendant Bestway (USA) Inc.'s Opening Expert Report of Samir Nayfeh, Ph.D. Relating to the Validity of U.S. Pat. No. 7,811,145; U.S. Pat. No. 8,079,888; and U.S. Pat. No. 8,066,540, filed on Nov. 3, 2016 in *Swimways Corporation et al.* v. *Bestway (USA) Inc.* 1:16-cv-608, 120 pages.

Schedule C-1 of Defendant Bestway (USA) Inc.'s Opening Expert Report of Samir Nayfeh, Ph.D. Relating to the Validity of U.S. Pat. No. 7,811,145; U.S. Pat. No. 8,079,888; and U.S. Pat. No.

(56) References Cited

OTHER PUBLICATIONS 8,066,540, filed on Nov. 3, 2016 in *Swimways Corporation et al.* v. *Bestway* (*USA*) *Inc.* 1:16-cv-608, 13 pages.
Schedule C-2 of Defendant Bestway (USA) Inc.'s Opening Expert Report of Samir Nayfeh, Ph.D. Relating to the Validity of U.S. Pat. No. 7,811,145; U.S. Pat. No. 8,079,888; and U.S. Pat. No. 8,066,540, filed on Nov. 3, 2016 in *Swimways Corporation et al.* v. *Bestway* (*USA*) *Inc.* 1:16-cv-608, 7 pages.
Schedule C-3 of Defendant Bestway (USA) Inc.'s Opening Expert Report of Samir Nayfeh, Ph.D. Relating to the Validity of U.S. Pat. No. 7,811,145; U.S. Pat. No. 8,079,888; and U.S. Pat. No. 8,066,540, filed on Nov. 3, 2016 in *Swimways Corporation et al.* v. *Bestway* (*USA*) *Inc.* 1:16-cv-608, 15 pages.
Schedule C-4 of Defendant Bestway (USA) Inc.'s Opening Expert Report of Samir Nayfeh, Ph.D. Relating to the Validity of U.S. Pat. No. 7,811,145; U.S. Pat. No. 8,079,888; and U.S. Pat. No. 8,066,540, filed on Nov. 3, 2016 in *Swimways Corporation et al.* v. *Bestway* (*USA*) *Inc.* 1:16-cv-608, 24 pages.
Schedule C-5 of Defendant Bestway (USA) Inc.'s Opening Expert Report of Samir Nayfeh, Ph.D. Relating to the Validity of U.S. Pat. No. 7,811,145; U.S. Pat. No. 8,079,888; and U.S. Pat. No. 8,066,540, filed on Nov. 3, 2016 in *Swimways Corporation et al.* v. *Bestway* (*USA*) *Inc.* 1:16-cv-608, 26 pages.
Schedule C-6 of Defendant Bestway (USA) Inc.'s Opening Expert Report of Samir Nayfeh, Ph.D. Relating to the Validity of U.S. Pat. No. 7,811,145; U.S. Pat. No. 8,079,888; and U.S. Pat. No. 8,066,540, filed on Nov. 3, 2016 in *Swimways Corporation et al.* v. *Bestway* (*USA*) *Inc.* 1:16-cv-608, 8 pages.
Schedule C-7 of Defendant Bestway (USA) Inc.'s Opening Expert Report of Samir Nayfeh, Ph.D. Relating to the Validity of U.S. Pat. No. 7,811,145; U.S. Pat. No. 8,079,888; and U.S. Pat. No. 8,066,540, filed on Nov. 3, 2016 in *Swimways Corporation et al.* v. *Bestway* (*USA*) *Inc.* 1:16-cv-608, 13 pages.
Examination Report for Australian Patent Application No. 2015203143, dated Sep. 23, 2016.
Claim Construction Order, dated Apr. 24, 2017, in *Swimways Corporation et al.* v. *Aqua-Leisure Industries, Inc.* 2:16-cv-00260, 33 pages.
Plaintiffs' Opening Claim Construction Brief, filed Feb. 28, 2017 in *Swimways Corporation et al.* v. *Aqua-Leisure Industries, Inc.* 2:16-cv-00260, 32 pages.
Aqua-Leisure's Opening Claim Construction Brief, filed Feb. 28, 2017 in *Swimways Corporation et al.* v. *Aqua-Leisure Industries, Inc.* 2:16-cv-00260, 34 pages.

COLLAPSIBLE FLOTATION DEVICE

CROSS REFERENCE TO RELATED APPLICATION

This application is a continuation of U.S. application Ser. No. 14/016,876, filed Sep. 3, 2013 (now U.S. Pat. No. 9,221,526), which is a continuation of U.S. application Ser. No. 13/328,779, filed Dec. 16, 2011 (now U.S. Pat. No. 8,523,623), which is a continuation of U.S. application Ser. No. 12/890,240, filed Sep. 24, 2010 (now U.S. Pat. No. 8,079,888), which is a continuation of U.S. application Ser. No. 12/400,214, filed Mar. 9, 2009 (now U.S. Pat. No. 7,811,145), which is a continuation of U.S. application Ser. No. 12/028,227, filed Feb. 8, 2008 (now U.S. Pat. No. 7,500,893), which is a continuation of U.S. application Ser. No. 11/554,197, filed Oct. 30, 2006 (now U.S. Pat. No. 7,335,080), which is a continuation of Ser. No. 11/143,703, filed Jun. 3, 2005 (now U.S. Pat. No. 7,134,930), which is a continuation of U.S. application Ser. No. 10/847,339, filed May 18, 2004 (now U.S. Pat. No. 7,147,528), which is a continuation of U.S. application Ser. No. 10/295,906, filed Nov. 18, 2002, (now U.S. Pat. No. 7,097,524), which is also a continuation of U.S. application Ser. No. 09/772,739, filed Jan. 30, 2001, (now U.S. Pat. No. 6,485,344), which claims priority from U.S. Provisional Application Ser. No. 60/238,988, filed Oct. 10, 2000; the entire disclosures of which are incorporated herein by reference.

BACKGROUND OF THE INVENTION

1. Field of the Invention

The present invention relates to inflatable flotation devices. In particular, the present invention relates to inflatable flotation devices which are collapsible through use of a spring mechanism.

2. Description of the Related Art

Inflatable flotation devices are well known in the form of floats, rafts, lifeboats, life preservers and other like devices. Previously known devices generally maintain their shape through air pressure alone and generally collapse when deflated.

In one of many examples, U.S. Pat. No. 3,775,782 issued to Rice et al. describes an inflatable rescue raft. When deflated, the raft can be rolled into a compact size.

Also well known in the art are collapsible items which are collapsible through the use of a collapsible metal or plastic spring. U.S. Pat. No. 4,815,784 shows an automobile sun shade which uses these collapsible springs. The springs are also used in children's play structures (U.S. Pat. Nos. 5,618,246 and 5,560,385) and tent-like shade structures (U.S. Pat. Nos. 5,579,799 and 5,467,794).

The collapsible springs are typically retained or held within fabric sleeves provided along the edges of a piece of fabric or other panel. The collapsible springs may be provided as one continuous loop, or may be a strip or strips of material connected at the ends to form a continuous loop. These collapsible springs are usually formed of flexible coilable steel, although other materials such as plastics are also used. The collapsible springs are usually made of a material which is relatively strong and yet is flexible to a sufficient degree to allow it to be coiled. Thus, each collapsible spring is capable of assuming two configurations, a normal uncoiled or expanded configuration, and a coiled or collapsed configuration in which the spring is collapsed into a size which is much smaller than its open configuration. The springs may be retained within the respective fabric sleeves without being connected thereto. Alternatively, the sleeves may be mechanically fastened, stitched, fused, or glued to the springs to retain them in position.

SUMMARY OF THE DISCLOSURE

A device comprises a spring and a sleeve. The spring is configured to form a closed loop. The spring is moveable between a coiled configuration when the spring is collapsed and an uncoiled configuration when the spring is expanded. The spring defines a circumference while in the uncoiled configuration. The spring is disposed within the sleeve. The sleeve includes an inflatable portion disposed about at least a portion of the circumference.

It is therefore an object of the present invention to provide a collapsible flotation device.

It is another object of the present invention to provide a collapsible flotation device which is easily collapsed and extended to full size through a mechanical means.

It is yet another object of the present invention to provide a collapsible flotation device which is easily collapsed and extended to full size through the use of a spring.

It is yet a further object of the present invention to provide a collapsible flotation device which requires minimal force to twist and fold into the collapsed configuration.

Finally, it is an object of the present invention to accomplish the foregoing objectives in a simple and cost effective manner.

DETAILED DESCRIPTION OF THE PREFERRED EMBODIMENTS

Figure 1:
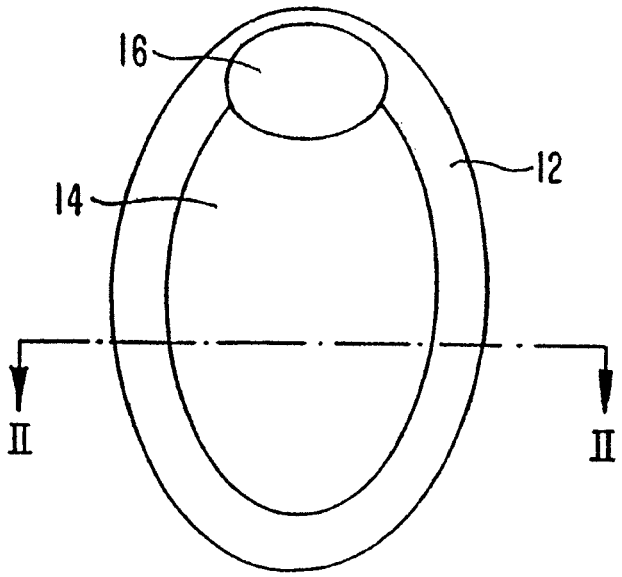
FIG. 1 is a top view of the preferred embodiment of the present invention.

The following detailed description is of the best presently contemplated modes of carrying out the invention. This description is not to be taken in a limiting sense, but is made merely for the purpose of illustrating general principles of embodiments of the invention.

The present invention provides a collapsible flotation device. The device includes a coilable metal or plastic spring. The coilable spring can be made from other materials, however, it is important that the coilable spring be made from a material that is strong and flexible. The spring must be coilable such that it folds on top of itself to become more compact. In its uncoiled state, the coilable spring can be round or oval or any shape satisfactory for use as a flotation device. Because it is to be used in water, the coilable spring is preferably either manufactured from a waterproof material or coated to protect any material which is not waterproof. The coilable spring can be a single continuous element or can include a joining means, such as a sleeve, for joining the ends of one or more spring elements together. The coilable spring can be of any appropriate shape and dimension. The coilable spring also has memory such that is biased to return to its uncoiled configuration when not held in the coiled configuration.

Stretched across the coilable spring is a flexible panel of material. The flexible panel can be one continuous piece or can be made up of several different types of material. In a preferred embodiment, the center portion of the flexible panel is mesh to allow water to flow through while the perimeter edges are nylon or polyester. At the edges of the flotation device, the material is a double thickness, forming a pocket around the perimeter of the flotation device. In this pocket are one or more inflatable chambers. One inflatable chamber may surround the entire perimeter of the flotation device or it may be divided into two or more inflatable chambers with each inflatable chamber having a means for inflating and deflating the inflatable chamber. In a preferred embodiment, one inflatable chamber is specifically designed to accommodate the user's head. In this embodiment, the pocket formed by the material is wider along a small portion of the perimeter of the flotation device to allow for a wider inflatable chamber. This will prevent the user's head from sinking below the rest of the user's body. The size of the inflatable chamber can vary significantly and need only be as wide as necessary to support the user's body weight. A preferred embodiment includes an inflatable chamber which is 3 inches in diameter when inflated. The inflatable chamber can be made from any appropriate float material but is preferably resistant to punctures. The coilable spring may also be located within the perimeter pocket. If one inflatable chamber is selected, the coilable spring can be placed inside or outside the inflatable chamber. If multiple inflatable chambers are used, the coilable spring will be outside the inflatable chambers. Alternatively, the coilable spring may be located outside the perimeter pocket along the outer edge of the flotation device. The coilable spring may be attached to the flexible panel through mechanical means such as fastening, stitching, fusing, or gluing.

Figure 2:
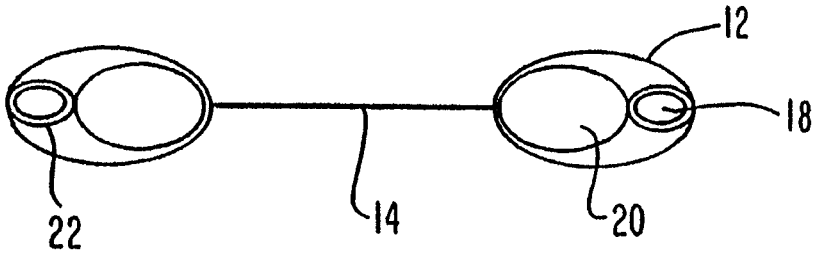
FIG. 2 is a cross sectional view of the preferred embodiment of the present invention taken along line II-II of FIG. 1.
Figure 3:
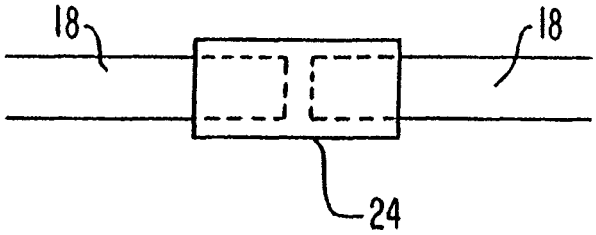
FIG. 3 is a view of a joining method as used in one embodiment of the present invention.

A preferred embodiment of the flotation device is shown in FIGS. 1 and 2 in its expanded configuration. The perimeter pocket 12 portion of the flexible panel is nylon while the central portion 14 of the flexible panel is made from a mesh material. The pillow 16 is part of the perimeter pocket 12 as it includes a double layer of fabric to accept an inflatable chamber 20 between the layers of fabric. In this particular embodiment, there are two inflatable chambers 20 in the perimeter pocket of the flotation device and one in the pillow 16, each of which includes a means for inflating the inflatable chamber 20. The inflation means is a valve on the underside of the flotation device. The inflatable chambers 20 in the perimeter pocket of the flotation device expand to approximately a 3-inch diameter when inflated. The coilable spring 18 is made from flexible, collapsible steel and is coated with a layer of PVC 22 to protect the coilable spring 18 from corroding and rusting due to contact with water during normal use of the flotation device. The coilable spring 18 also has memory such that will open to its uncoiled configuration when not held in the coiled configuration. The coilable spring 18 can be a single unitary element or can include sleeves 24 for joining the ends of one or more strips as shown in FIG. 3 in which the ends of the coilable spring 18 within the sleeve 24 are shown in dashed lines for clarification.

Figure 4:
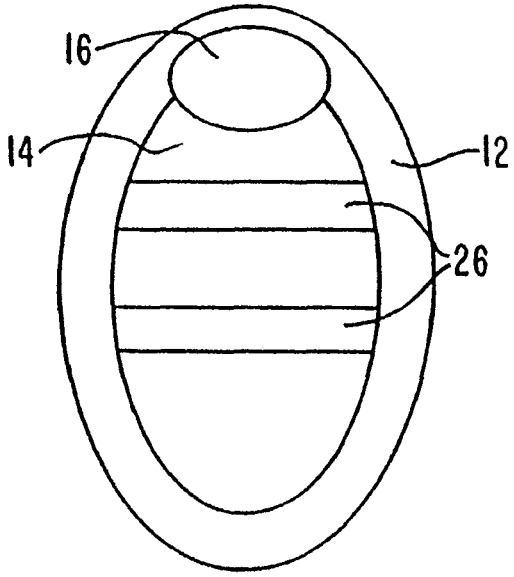
FIG. 4 is a top view of an alternate embodiment of the present invention.
Figure 5:
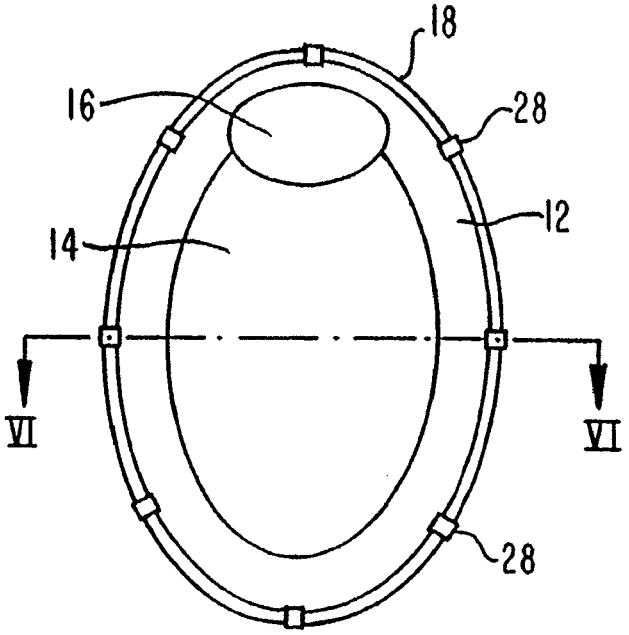
FIG. 5 is a top view of another alternate embodiment of the present invention.
Figure 6:
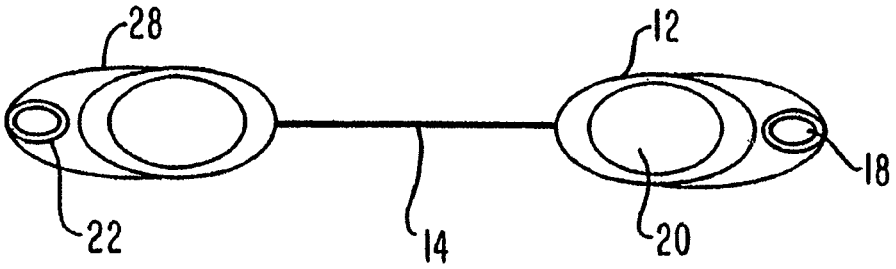
FIG. 6 is a cross section view of the alternate embodiment of the present invention across line VI-VI of FIG. 5.
Figure 7:
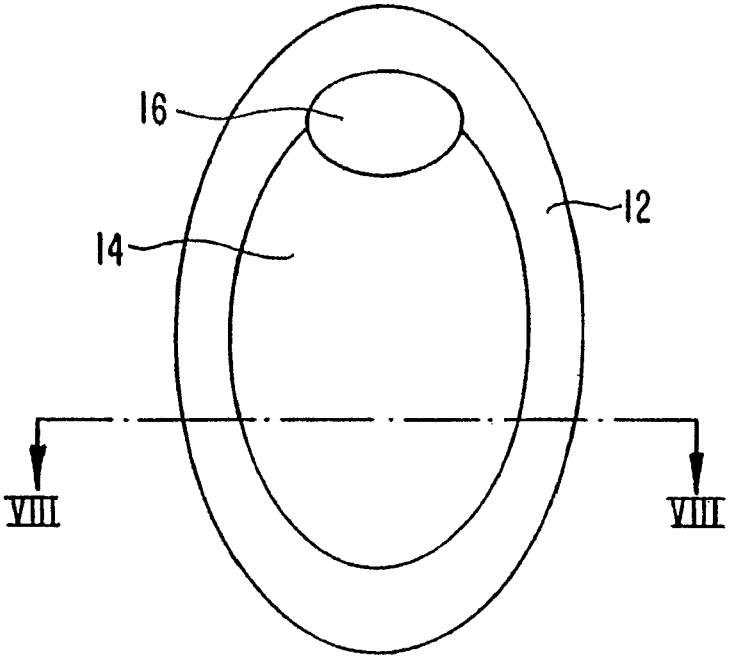
FIG. 7 is a top view of an alternative embodiment of the present invention.
Figure 8:
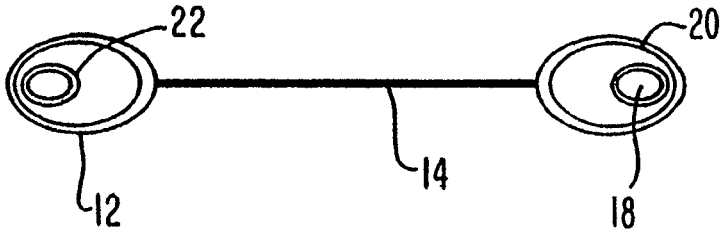
FIG. 8 is a cross sectional view of the embodiment of the present invention, taken along line VIII-VIII of FIG. 7.
Figure 9:
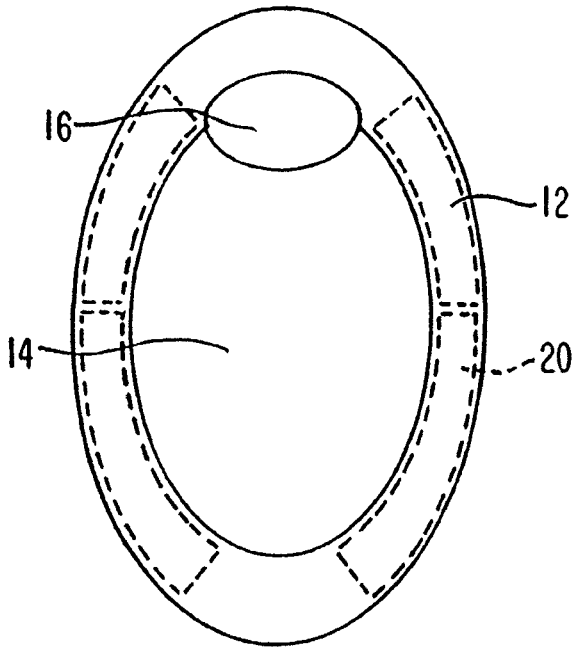
FIG. 9 is a plan view of another embodiment of the present invention.

Alternatively or in addition to the perimeter inflatable chambers, the device can include inflatable chambers 26 which cross the panel as shown in FIG. 4. FIGS. 5 and 6 show a further alternate embodiment of the present invention in which the coilable spring 18 is attached to the external perimeter of the pocket portion 12 of the flexible panel through the use of a mechanical means. In this particular embodiment, several loops 28 are used to attach the coilable spring 18 to the pocket portion 12 of the flexible panel.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. An apparatus, comprising:

a panel having an interior region and an outer region disposed about the interior region, the interior region including a mesh material having an outer perimeter portion, the mesh material having a maximum length greater than a maximum width of the mesh material;

the outer region including a first layer of material and a second layer of material, an inner perimeter portion of each of the first layer of material and the second layer of material being fixedly coupled to the outer perimeter portion of the mesh material of the interior region, and an outer perimeter portion of the outer region having an ellipsoidal shape, at least a portion of the outer perimeter portion of the mesh material having a non-ellipsoidal shape;

a first inflatable bladder disposed between the first layer of material and the second layer of material of the outer region of the panel; and a second inflatable bladder disposed between the first layer of material and the second layer of material of the outer region of the panel;

at least one of the first inflatable bladder or the second inflatable bladder having a sufficient size when inflated to maintain the apparatus in an extended configuration and support a weight of a user of the apparatus when the apparatus is disposed in water and the user is disposed on the apparatus.

2. The apparatus of claim 1, wherein at least one of the first layer of material and the second layer of material is different from the mesh material.

3. The apparatus of claim 1, wherein:

the first layer of material of the outer region and the second layer of material of the outer region define a pocket therebetween, the first inflatable bladder is disposed within the pocket, the first inflatable bladder has a substantially U-shaped portion, a portion of the substantially U-shaped portion of the inflatable bladder has a first width, and the second inflatable bladder is disposed within the pocket, the second inflatable bladder having a second width, the second width greater than the first width.

4. The apparatus of claim 1, wherein the interior region is substantially planar when the first inflatable bladder is inflated, when the apparatus is in the extended configuration, and when the user is not disposed on the apparatus.

5. The apparatus of claim 1, further comprising:

a valve coupled to the second layer of material, the valve configured to communicate air to the first inflatable bladder.

6. The apparatus of claim 1, further comprising:

a first valve coupled to the first inflatable bladder and configured to communicate air to the first inflatable bladder; and a second valve coupled to the second inflatable bladder and configured to communicate air to the second inflatable bladder.

7. The apparatus of claim 1, wherein the second inflatable bladder has a length and a width when inflated, the width being greater than the length to support a user's head above a remaining portion of the user's body when the second inflatable bladder is inflated, when the apparatus is disposed in water and when the user is disposed on the apparatus.

8. The apparatus of claim 1, wherein:

the mesh material has a centerline defined along the maximum length of the mesh material, and the second inflatable bladder has a maximum width greater than a maximum length of the second inflatable bladder, the second inflatable bladder has a centerline defined along the maximum length of the second inflatable bladder, the centerline of the second inflatable bladder is substantially aligned with the centerline of the mesh material.

9. An apparatus, comprising:

a mesh material configured to expose at least a portion of a body of a user to water when the user is disposed on the apparatus and the apparatus is disposed in water, the mesh material having a maximum length greater than a maximum width of the mesh material;

a flexible material disposed about and fixedly coupled to a perimeter of the mesh material, the flexible material having a first layer and a second layer and defining at least one pocket between the first layer and the second layer;

a first inflatable bladder disposed in the at least one pocket at a first location, the first location of the at least one pocket being contiguous with a first portion of the perimeter of the mesh material; and a second inflatable bladder disposed in the at least one pocket at a second location different from the first location, the second location of the at least one pocket being contiguous with a second portion of the perimeter of the mesh material different from the first portion of the perimeter of the mesh material, the first portion of the perimeter of the mesh material and the second portion of the perimeter of the mesh material together being an entirety of the perimeter of the mesh material;

the first inflatable bladder and the second inflatable bladder collectively defining an interior region, the mesh material being disposed within the interior;

at least one of the first inflatable bladder or the second inflatable bladder having a sufficient size when inflated to support a weight of the user when the apparatus is disposed in water and the user is disposed on the apparatus.

10. The apparatus of claim 9, wherein at least one of the first layer of flexible material or the second layer of flexible material is different from the mesh material.

11. The apparatus of claim 9, wherein the mesh material of the interior region is substantially planar when the first inflatable bladder is inflated and when the user is not disposed on the apparatus.

12. The apparatus of claim 9, further comprising:

a first valve coupled to the first inflatable bladder and configured to communicate air to the first inflatable bladder; and a second valve coupled to the second inflatable bladder and configured to communicate air to the second inflatable bladder.

13. The apparatus of claim 9, wherein the second inflatable bladder has a length and a width when inflated, the width being greater than the length to support a user's head above a remaining portion of the user's body when the second inflatable bladder is inflated.

14. The apparatus of claim 9, further comprising:

a third inflatable bladder disposed in the at least one pocket at a third location different from the first location and different from the second location.

15. An apparatus, comprising:

a first flexible material having an outer perimeter portion, the first flexible material including a mesh material, the first flexible material having a length and a width, a maximum length of the first flexible material being greater than a maximum width of the first flexible material;

a second flexible material having an inner perimeter portion and an outer perimeter portion, the second flexible material defining a sleeve, the inner perimeter portion of the second flexible material being coupled to the outer perimeter portion of the first flexible material, the second flexible material being different from the first flexible material, the outer perimeter portion of the second flexible material having an ellipsoidal shape, at least a portion of the inner perimeter portion of the second flexible material having a non-ellipsoidal shape;

a first inflatable bladder disposed at a first location within the sleeve defined by the second flexible material; and a second inflatable bladder disposed at a second location within the sleeve defined by the second flexible material, the second location being opposite the first location with respect to the length of the first flexible material;

the first inflatable bladder and the second inflatable bladder collectively defining an interior region, the first flexible material being disposed within the interior region, the first inflatable bladder and the second inflatable bladder collectively configured, when inflated, to support a user on the apparatus when the apparatus is disposed in water and the user is disposed in a supine position on the apparatus.

16. The apparatus of claim 15, wherein the first flexible material is substantially planar when the first inflatable bladder is inflated, when the second inflatable bladder is inflated, and when the user is not disposed on the apparatus.

17. The apparatus of claim 15, further comprising:

a valve coupled to the second flexible material, the valve configured to communicate air to at least one of the first inflatable bladder or the second inflatable bladder.

18. The apparatus of claim 15, wherein:

the first inflatable bladder has a substantially U-shaped portion, a portion of the substantially U-shaped portion of the first inflatable bladder has a first width, and the second inflatable bladder having a second width, the second width greater than the first width.

19. The apparatus of claim 15, wherein the first inflatable bladder has a first width when the first inflatable bladder is inflated, the second inflatable bladder has a second width when the second inflatable bladder is inflated, the second width is greater than the first width.

20. The apparatus of claim 15, further comprising:

a spring coupled to the second flexible material, the spring being moveable between a coiled configuration when the spring is collapsed and an uncoiled configuration when the spring is expanded.

* * * * *